US007049919B2

(12) United States Patent
Yamaki

(10) Patent No.: US 7,049,919 B2
(45) Date of Patent: May 23, 2006

(54) MAGNETIC ADSORPTION DEVICE AND PRODUCTION METHOD THEREOF AND MAGNETIC APPARATUS

(75) Inventor: Masaru Yamaki, Ueda (JP)

(73) Assignee: Kanetec Kabushiki Kaisha, Ueda (JP)

( * ) Notice: Subject to any disclaimer, the term of this patent is extended or adjusted under 35 U.S.C. 154(b) by 29 days.

(21) Appl. No.: 10/779,389

(22) Filed: Feb. 13, 2004

(65) Prior Publication Data

US 2004/0263302 A1 Dec. 30, 2004

(30) Foreign Application Priority Data

Jun. 24, 2003 (JP) ..... 2003-180033

(51) Int. Cl.
*H01F 7/02* (2006.01)
*H01F 7/20* (2006.01)

(52) U.S. Cl. ..... 335/288; 294/65.5; 269/8

(58) Field of Classification Search ..... 335/285–295; 269/8; 294/65.5
See application file for complete search history.

(56) References Cited

U.S. PATENT DOCUMENTS 2,561,769 A * 7/1951 Anderson ..... 335/289
3,142,787 A * 7/1964 Levesque ..... 335/295
5,435,613 A 7/1995 Jung

FOREIGN PATENT DOCUMENTS

| | | |
|---|---|---|
| JP | 7 (1995)-47845 | 11/1995 |
| JP | 3025361 | 3/1996 |
| JP | 2002-055186 | 2/2002 |
| WO | WO99/65644 | 12/1999 |

* cited by examiner

*Primary Examiner*—Ramon M. Barrera
(74) *Attorney, Agent, or Firm*—Graybeal Jackson Haley LLP

(57) ABSTRACT

A magnetic adsorption device comprises: a magnetic circuit block having a cavity extending in one direction and divided into a plurality of magnetic pole members at intervals in the circumferential direction of the cavity by a plurality of spacers; and a permanent magnet assembly having an N pole and an S pole and capable of rotating selectively at a first and a second positions spaced apart about an axis of the cavity so as to adsorb and release a magnetic substance. Adjoining spacers about the axis are distant by an angular space of less than 180° about the axis.

16 Claims, 20 Drawing Sheets

MAGNETIC ADSORPTION DEVICE AND PRODUCTION METHOD THEREOF AND MAGNETIC APPARATUS

BACKGROUND OF THE INVENTION

1. Field of the Invention

The present invention relates to a permanent magnet-type magnetic adsorption device, its production method, and a magnetic apparatus.

2. Description of Prior Art

A permanent magnet-type magnetic adsorption device generally uses one or more permanent magnets and magnetically adsorbs a magnetic substance by magnetic force generated by the permanent magnet. Some of such permanent magnet-type magnetic adsorption devices are described in Patent Documents 1, 2 and 3, etc.

[Patent Document 1]

Japanese Patent Appln. Public Disclosure No. 2002-55186

[Patent Document 2]

Japanese National Public Disclosure No. 2002-518268

[Patent Document 3]

Japanese Utility Model Registration No. 3025361

All these devices include a magnetic circuit block having a cavity circular in sectional shape and having an axis extending in one direction, and a permanent magnet assembly having the N pole and S pole and disposed about the axis of the cavity so as to rotate angularly.

The magnetic circuit block is halved by a pair of spacers into a pair of magnetic pole members, but is formed integrally in appearance by welding or binding. The magnetic circuit block has an adsorption portion to adsorb a magnetic substance such as a work-piece, an iron plate, steel products, etc.

The permanent magnet assembly is made rotatable at first and second positions spaced apart about the axis. The permanent magnet assembly includes a bar-like magnetic member disposed within the cavity and at least one set of permanent magnets disposed around the magnetic members.

One of the permanent magnets of each set is attached to the magnetic member at either one of the N pole and S pole and directs the other of the N pole and S pole the inner periphery forming the cavity. The other of the permanent magnets in each set directs either one of the N pole and S pole toward the inner periphery forming the cavity, and is attached to the rotatable magnetic member at the other of the N pole and S pole.

Either one of the first and second positions is located at a position where a line of magnetic force leaks in the adsorption portion and is capable of adsorbing the magnetic substance on the adsorption portion. The other of the first and second positions is located at a position where the line of magnetic force does not leak in the absorbing portion and is incapable of adsorbing the magnetic substance on the adsorption portion.

Such a magnetic adsorption device is turned on to be capable of adsorbing the magnetic substance when the permanent magnet assembly is rotated to one of the first and second positions, and turned off to be incapable of adsorbing the magnetic substance when the permanent magnet assembly is rotated to the other of the positions.

According to a conventional permanent magnet-type magnetic adsorption device, however, since two adjoining spacers about the axis of a cavity forms an angle of 180° about the axis of the cavity, it is necessary to rotate the permanent magnet assembly to either a first position or a second position by rotating the permanent magnet assembly by 90°. For this reason, in the conventional permanent magnetic adsorption device, a range of angular rotation (angle of rotating operation) of the permanent magnet assembly required for turning the adsorption device itself on or off is great.

SUMMARY OF THE INVENTION

An object of the present invention is to have a permanent magnet's own so-called initial adsorption force displayed by a rotational operation of a small angle.

A magnetic adsorption device according to the present invention comprises: a magnetic circuit block having a cavity extending in one direction and divided into a plurality of magnetic pole members at intervals in the circumferential direction of the cavity by a plurality of spacers; and a permanent magnet assembly having an N pole and an S pole and capable of rotating selectively to a first position and a second position spaced apart about an axis of the cavity so as to adsorb and release a magnetic substance. The spacers adjacent to each other about the axis are angularly spaced apart at an angle smaller than 180° about the axis.

The N poles and S poles of one and the other permanent magnets are respectively opposed to the one and the other of the magnetic pole members at the first position, and are opposed to both magnetic pole members at the second positions.

The foregoing magnetic adsorption device is turned on to be capable of adsorbing a magnetic substance when the permanent magnet assembly is rotated to one position, and is turned off to be incapable of adsorbing a magnetic substance when the permanent magnet assembly is rotated to the other position.

A range of angular rotation of the permanent magnet assembly required for turning the magnetic adsorption device on and off is half the angle (less than 90°) of an angle (less than 180°) formed by a pair of spacers. Therefore, according to the present invention, it is possible to sufficiently display, by a small angular rotational operation, so-called initial adsorption force which is naturally generated by the disposed permanent magnet of a volume.

The angle formed by the adjoining spacers about the axis can be in an angular range from 50° to 150°, and also in an angular range from 60° to 120°. Thereby, the angle of rotational operation can be effectively reduced without lowering the initial adsorption force to be generated by the permanent magnet.

The permanent magnet assembly includes a bar-like magnetic member disposed in the cavity and a pair of permanent magnets disposed around the magnetic member. One and the other permanent magnets respectively direct the one and the other of the N pole and S pole toward the magnetic member and direct the other and the one of the N pole and S pole toward the inside of the cavity. Thereby, since much force applied to the permanent magnet assembly is absorbed in the magnetic member, the mechanical strength of the permanent magnet assembly becomes high in comparison with a case where the permanent magnet assembly is made only of a permanent magnet material.

The permanent magnet can include a plate-like magnet with high coersive force magnetized in its thickness direction. Thereby, a rotational resistance at the time of turning the magnetic adsorption device from on to off becomes small, which facilitates the switching work.

The cavity and the magnetic member may have circular sectional shapes. The permanent magnet may be curved like an arc. This makes the distance between the inner face of the cavity and the permanent magnet small, so that the adsorption force of the permanent magnet can be effectively displayed.

The magnetic adsorption device can further comprise: an end plate attached to one end portion of the magnetic circuit block in the axial direction and having a through hole through which the one end portion of the permanent magnet assembly in the axial direction extend; and a rotating member connected with the one end portion of the permanent magnet assembly in the axial direction so as to angularly rotate the permanent magnet assembly about the axis of the cavity.

The rotating member can include a handle connected with the one end portion of the permanent magnet assembly so as to rotate angularly about an imaginary axis extending in a direction crossing the axis of the cavity, and the end plate can include a first and a second recesses for receiving the handle so as to releasably maintain the permanent magnet assembly selectively at the first and second positions. Thus, by receiving the handle selectively in the first and second recesses, the adsorption device can be maintained selectively in the ON and OFF states.

The magnetic adsorption device can further comprise a pusher disposed in the permanent magnet assembly so as to apply force to the handle in the direction for the handle to be received in the first and second recesses. According to this constitution, so long as the handle received in the first or second recess is not removed from the first or second recess against the force applied by the pusher, the handle is maintained in a state of being received in the first or second recess, thereby preventing the adsorption device from being switched by mistake from ON to OFF or vice versa.

The end plate can further have an inclined face between the first and second recesses such that a portion nearer either one of the first recess and the second recess comes nearer the opposite side to the magnetic circuit block side: According to this constitution, by removing the handle received in the second recess from the first or second recess and moving the handle toward the second or first recess in a state of being in contact with the inclined face, the magnetic adsorption device can be switched from OFF to ON or vice versa, thereby facilitating the switching work.

The magnetic circuit block can have one or two magnetic adsorption portions.

The magnetic apparatus according to the present invention comprises a plurality of magnetic adsorption devices having such a constitution as mentioned above and a connecting member connected with the plurality of magnetic adsorption devices. According to this magnetic apparatus, adsorption force can be raised without making the magnetic apparatus itself large-sized in comparison with a magnetic apparatus using one magnetic adsorption device.

The connecting member may be made capable of engaging a suspension member. In place thereof, the magnetic apparatus may further include an engaging member connected with the connecting member or both magnetic adsorption devices, wherein the engaging member can engage the suspension member.

In the magnetic apparatus, each of the magnetic adsorption devices may have at least one magnetic adsorption portion, and adjoining magnetic adsorption devices may be connected so as to be located on the same side.

In place of the above, each of the magnetic adsorption devices may have at least one magnetic adsorption portion, and adjoining magnetic adsorption devices may be connected such that the magnetic adsorption portions are at angular intervals around an imaginary circle. Thereby, a deformation material such as an L-shaped steel can be surely adsorbed.

The method of producing a magnetic adsorption device according to the present invention comprises steps of: forming a groove opening on the outside face of a cylindrical member made of a magnetic material and extending in the longitudinal direction of the cylindrical member at a plurality of positions at intervals in the circumferential direction of an imaginary circle; disposing a strip-shaped non-magnetic member extending in the longitudinal direction of the cylindrical member in the groove; connecting the non-magnetic member with the cylindrical member; and machining the inside member of the cylindrical member.

According to the foregoing production method, in comparison with a case of machining the cavity face after a plurality of magnetic pole members are connected by a spacer, it is possible to dispose the non-magnetic members to connect the non-magnetic members and the cylindrical member, and machine the cavity face, so that the connection work of the magnetic pole member and the spacers as well as the machining work of the cavity face becomes easier.

The step of machining the inside member of the cylindrical member can include removing the inside face of the cylindrical member to such an extent as the leakage of a magnetic flux at least between regions divided by the groove can be ignored.

The width of the non-magnetic member can be smaller than the depth of the groove, and connecting the non-magnetic member with the cylindrical member can include filling a non-magnetic welding material in the remaining space within the groove excluding the space where the non-magnetic member is disposed.

PREFERRED EMBODIMENT OF THE INVENTION

Embodiment of the Magnetic Adsorption Device

Figure 1:
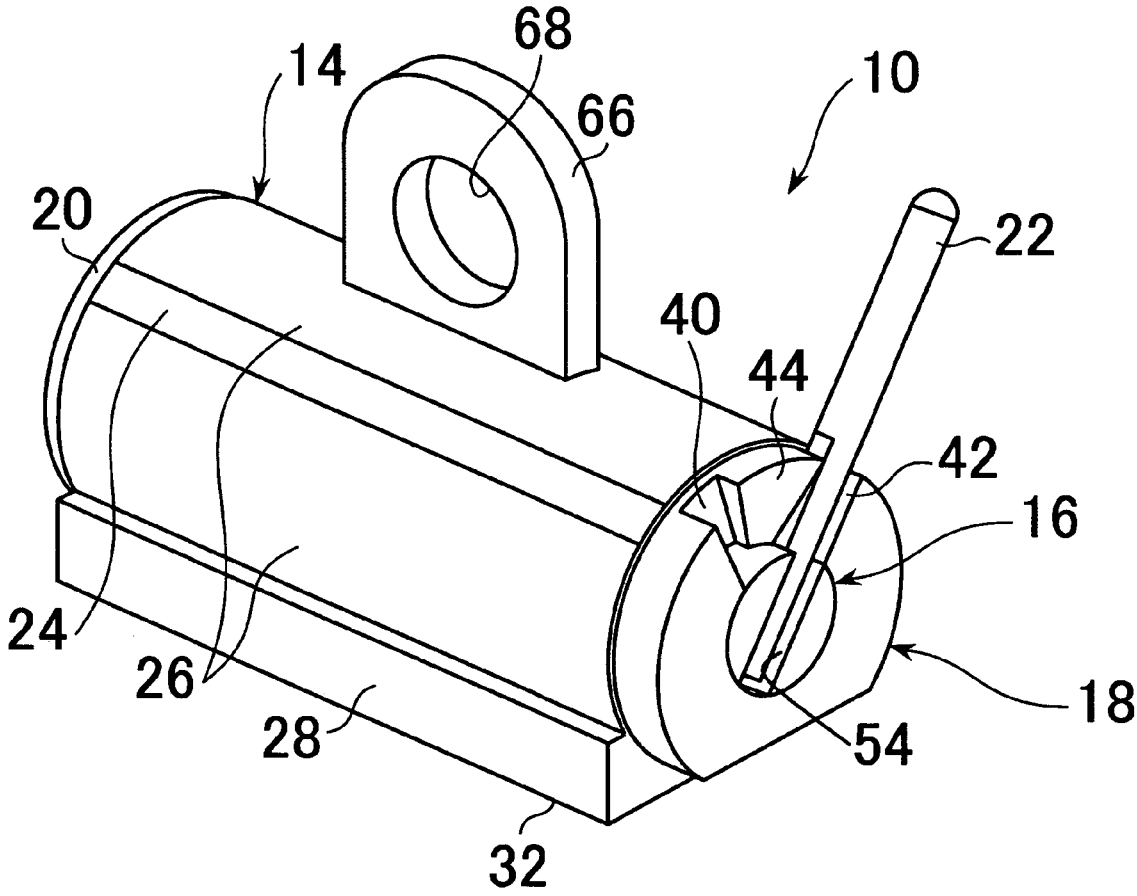
FIG. 1 is a perspective view showing an embodiment of the magnetic adsorption device according to the present invention.
Figure 2:
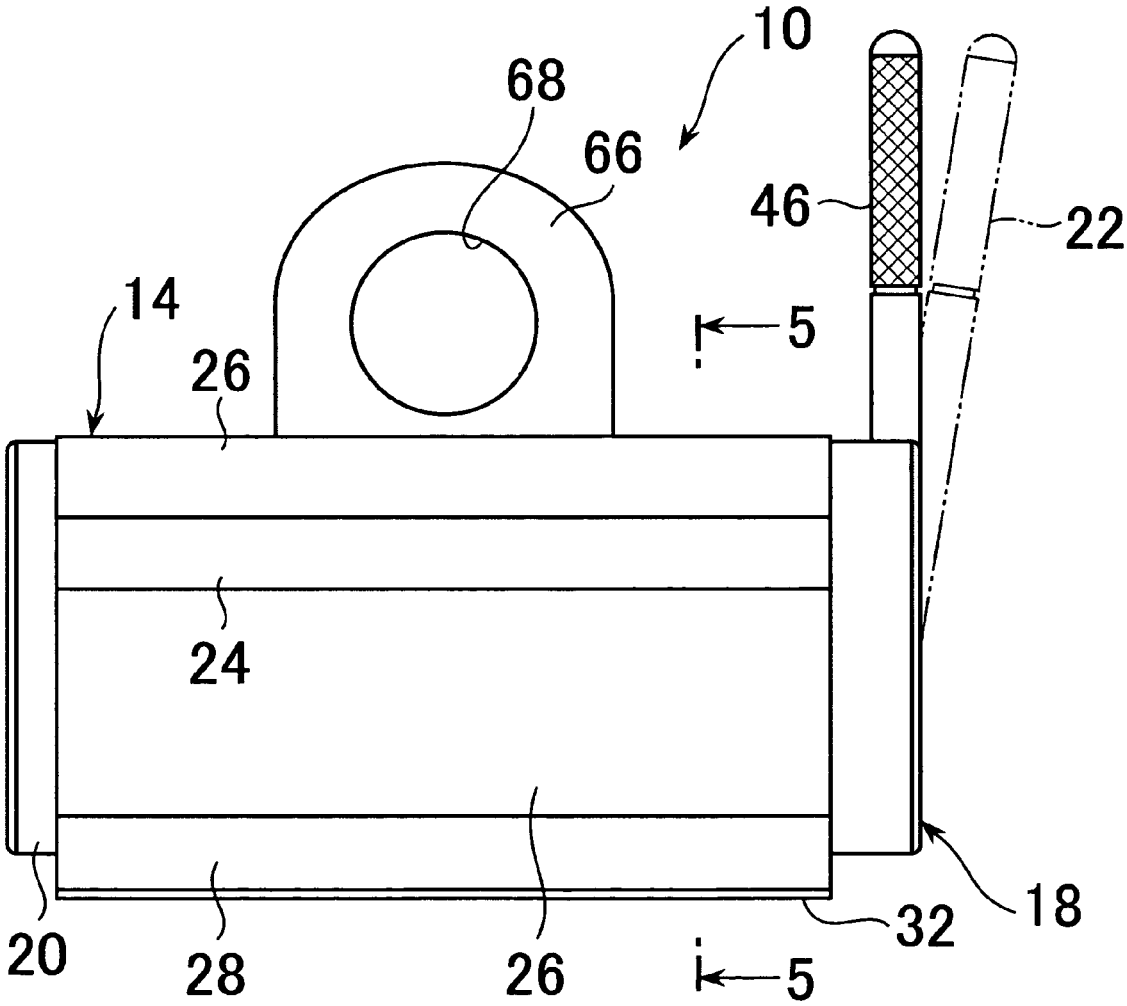
FIG. 2 is a front elevation of the magnetic adsorption device shown in FIG. 1.
Figure 3:
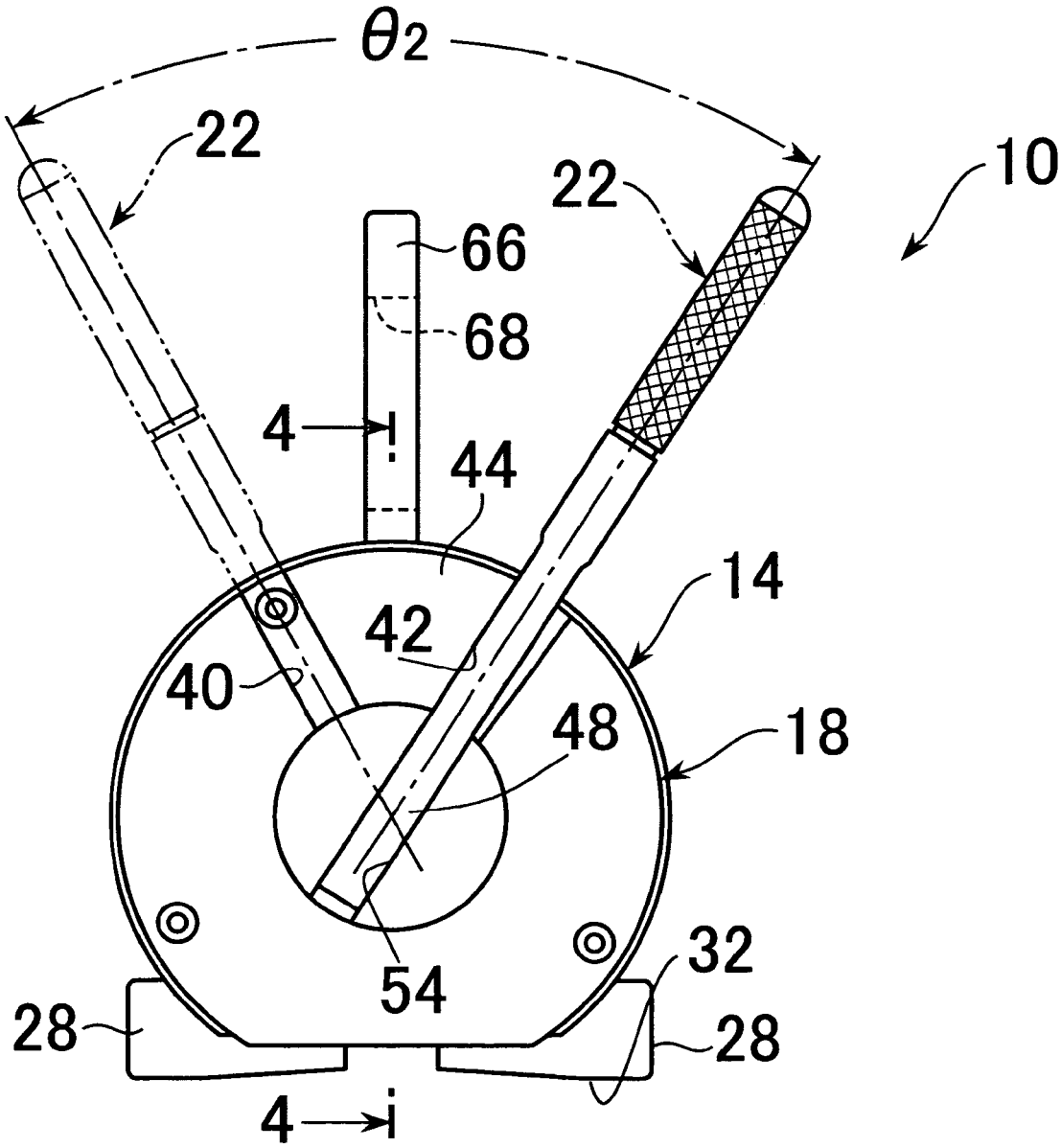
FIG. 3 is a right side view of the magnetic adsorption device shown in FIG. 1.
Figure 4:
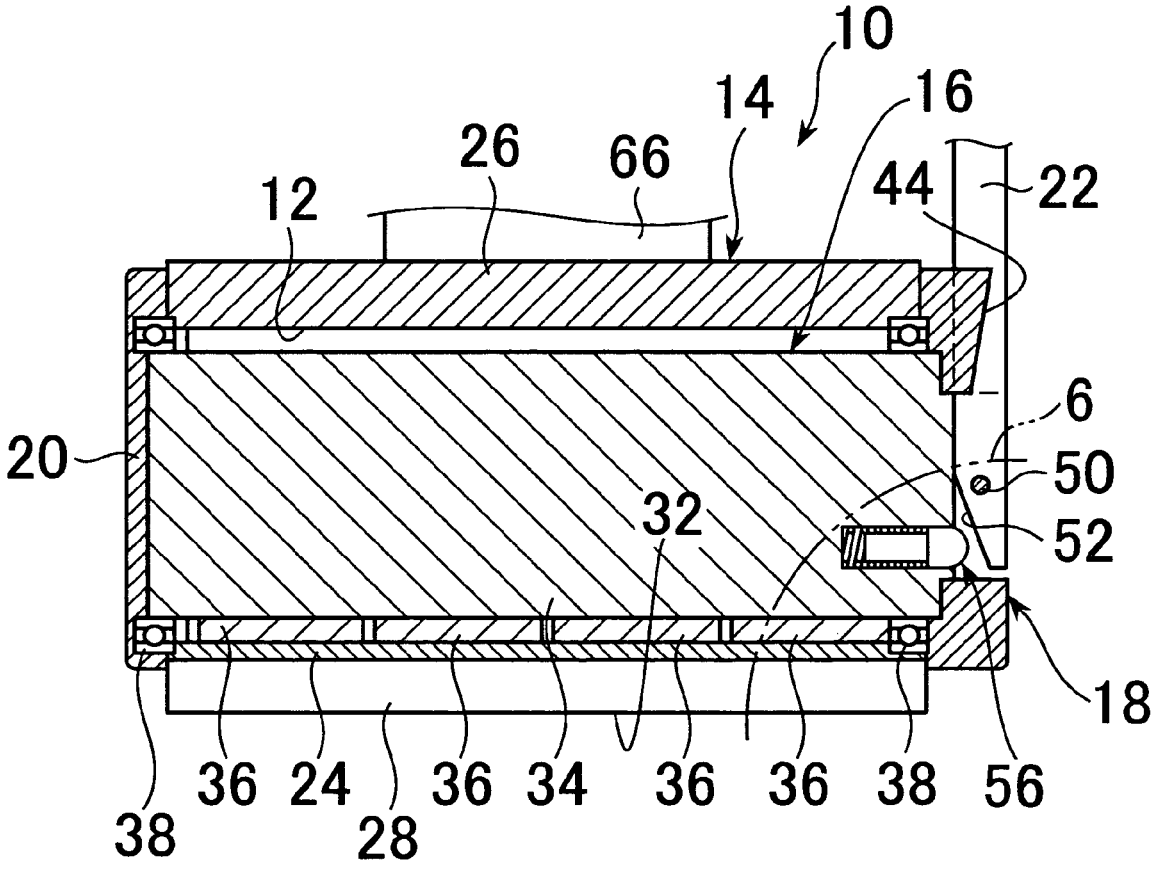
FIG. 4 is a sectional view obtained along the line 4—4 in FIG. 3.

Referring to FIGS. 1 through 10, the permanent magnet-type magnetic adsorption device 10 comprises: a magnetic circuit block 14 provided with a cavity 12 extending in one direction; a permanent magnet assembly 16 disposed within the cavity 12 so as to angularly rotate about the axis of the cavity 12; end plates 18 and 20 attached to one end and the other end portions of the magnetic circuit block 14; and a bar-like handle 22 connected with the one end portion of the permanent magnet assembly 16.

The cavity 12 penetrates the magnetic circuit block 14. In the illustration, the sectional shape of the cavity 12 is circular. The magnetic circuit block 14 extends in the axial direction of the cavity 12.

The magnetic circuit block 14 is divided by two spacers 24 into two magnetic pole members 26 and 26 made of a magnetic material at intervals in the circumferential direction of the cavity 12. Seats 28 and 28 made of a magnetic material are attached respectively to the magnetic pole members 26 and 26.

Each spacer 24 is made of a non-magnetic material into a strip-shaped plate form, and sandwiched by both magnetic pole members 26 and 26. Each spacer 24, in the illustration, are firmly connected with both magnetic pole members 26 and 26 by welding using a non-magnetic welding material, but it may be firmly connected with both magnetic pole members 26 and 26 by a non-magnetic bonding agent.

Both magnetic pole members 26 and 26 form a substantially cylindrical shape extending in the axial direction of the cavity 12, and the outside portions on one spacer side are made a flat face to form a mounting face 30 perpendicular to the diametrical direction of the cavity 12 in collaboration.

The circumferential dimensions of both magnetic pole members 26 and 26 are different. For this reason, adjoining spacers 24 forms an angle θ 1 smaller than 180° about the axis of the cavity 12. A concrete value of the angle θ 1 will be explained later.

The seats 28 and 28 are firmly attached to the mounting face 30 by welding, bolts or the like so as to oppose each other with one of the spacers 24 interposed so that the seats can form a magnetic adsorption face 32 in collaboration.

The permanent magnet assembly 16 includes a magnetic member 34 disposed rotatably within the cavity 12 and plural sets of permanent magnets 36 arranged around the magnetic member 34.

The magnetic member 34 is made of a magnetic material, and is supported at the magnetic circuit block 14 by a plurality of bearings 38 so as to be rotatable about the axis of the cavity 12. One end portion of the magnetic member 34 is made thiner than the other region and rotatably penetrates the end plate 18. The magnetic member 34 has a substantially circular sectional shape in the illustration.

Each permanent magnet 36 is made a plate-like magnet having high coersive force such as a ferrite magnet or a rare earth metal magnet, magnetized in the thickness direction, curved like an arc to be an inside face having the same ratio of curvature as that of the outer peripheral face of the magnetic member 34, and is attached to the outer peripheral face of the magnetic member 34 so as not to move relatively.

One of the permanent magnets 36 of each set brings either its N pole or S pole into contact with the magnetic member 34, while the other of its N pole or S pole is directed to the inner peripheral face of the cavity 12. On the other hand, the other of permanent magnets 36 of each set makes one of its N pole or S pole directed to the inner peripheral face of the cavity 12, while the other of its N pole and S pole is brought into contact with the magnetic member 34.

One and the other of the permanent magnets 36 of each set are respectively disposed in the magnetic member 34 such that the other and one of the N pole and S pole oppose to the magnetic pole members 26 and 26 at a first position where the magnetic adsorption device 10 turns on to be able to adsorb a magnetic substance, and oppose to both magnetic pole members 26 and 26 in common at a second position where the magnetic adsorption device 10 turns off not to be able to adsorb the magnetic substance.

The end plates 18 and 20 are made of a non-magnetic material, have substantially the same size as the end face of the magnetic circuit block 14, and are attached to the corresponding end portions of the magnetic circuit block 14 by screw members. The end plate 18 is ring-shaped so as to receive one end portion of the magnetic member 34, while the end plate 20 is substantially disk-shaped.

The end plate 18 has a first and a second recesses 40 and 42 extending in the radial direction so as to receive a part of the handle 22 to maintain releasably the permanent magnet assembly 16 selectively at the first and the second positions. The first and second recesses 40 and 42 are open on the side opposite to the side of the magnetic circuit block.

The region between the first and second recesses 40 and 42 is made to be an inclined face 44 of which the portion nearer the side of the first recess 40 projects toward the side opposite to the side of the magnetic circuit block 14 and the portion nearer the outside projects toward the side opposite to the magnetic circuit block 14.

Figure 10A:
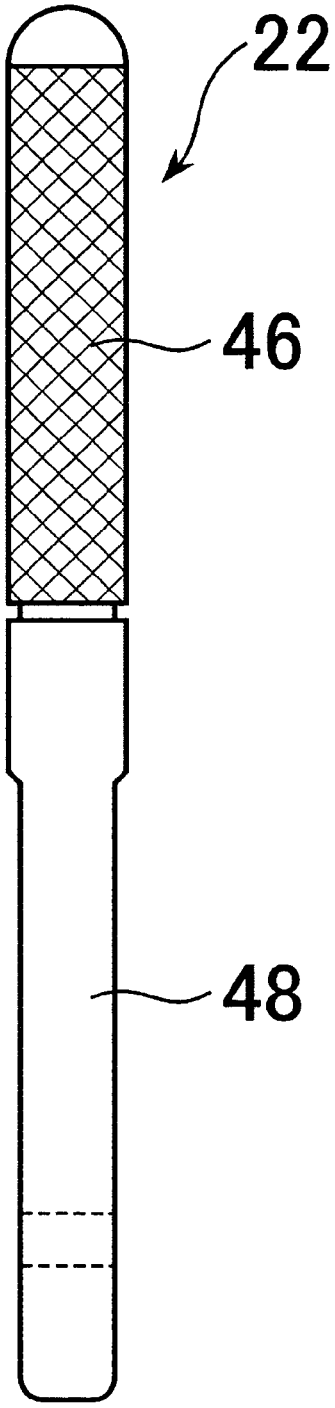
FIGS. 10(A) and (B) are views showing an embodiment of a handle used in the magnetic adsorption device shown in FIG. 1, in which (A) is a front elevation and (B) a side view.
Figure 10B:
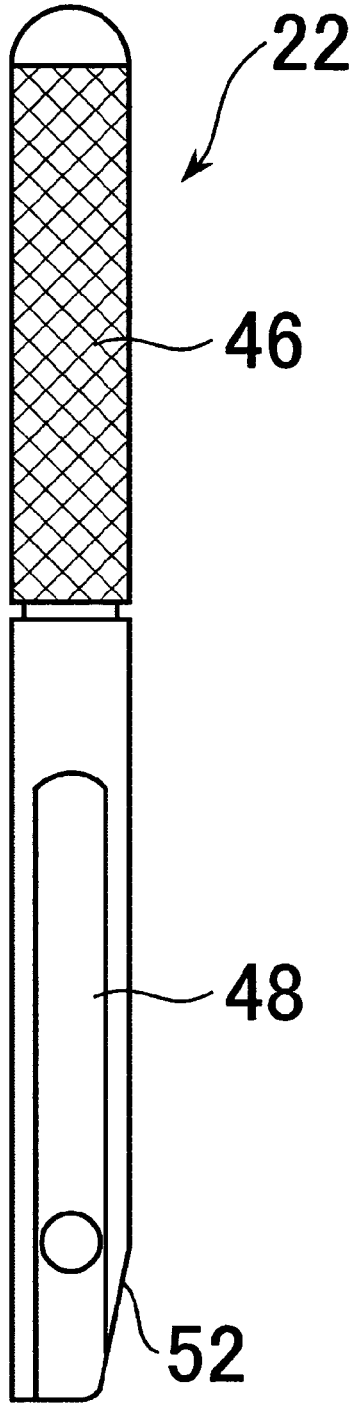

As shown in FIG. 10, the handle 22 has a roulette-worked holding portion 46 at one end and an attaching portion 48 formed like an oval-shaped race course at the other end portion.

The handle 22 is connected with one end portion of the magnetic member 34 by a pivot 50 in the attaching portion 48 so as to rotate angularly about an imaginary axis extending in the diametrical direction of the cavity 12. The handle 22 also has on the side of the magnetic member 34 a pressed face 52 inclined such that the portion nearer the side of the end portion becomes anti-center side (to be away from the magnetic circuit block 14).

The magnetic member 34 has at its one end portion a groove 54 for receiving the attaching portion 48 of the handle 22. The groove 54 is open at one end face of the magnetic member 34 and extends in the diametric direction of the magnetic member 34.

The magnetic adsorption device 10 further comprises a pusher 56 for applying force to the handle 22 in the direction for the handle 22 to be received in the first and second recesses 40 and 42. The pusher 56 is disposed in a blind hole 58 formed in the magnetic member 34 as shown in detail in FIG. 6. The blind hole 58 is open on one end face of the magnetic member 34.

The pusher 56 is provided with an elastic body 60 disposed in the blind hole 58 and a pushing pin 62 to be applied force in the projecting direction from the blind hole 58. The elastic body 60 is a compression coil spring in the illustration but may be another elastic member such as rubber.

One end side of the pushing pin 62 has a smaller diameter than the other end side so as to be received in the elastic body 60, and is applied force by the elastic body 60. The front end of the other end portion of the pushing pin 62 is pressed against the pressed face 52 of the handle 22. Thereby, the handle 22 is applied force in the direction for the attaching portion 48 to be received in the first and second recesses 40 and 42.

The end face of the other end side of the pushing pin 62 is shaped like a hemispherical arc-shaped face. This facilitates the angular rotation of the handle 22 about the pivot 50.

Figure 5A:
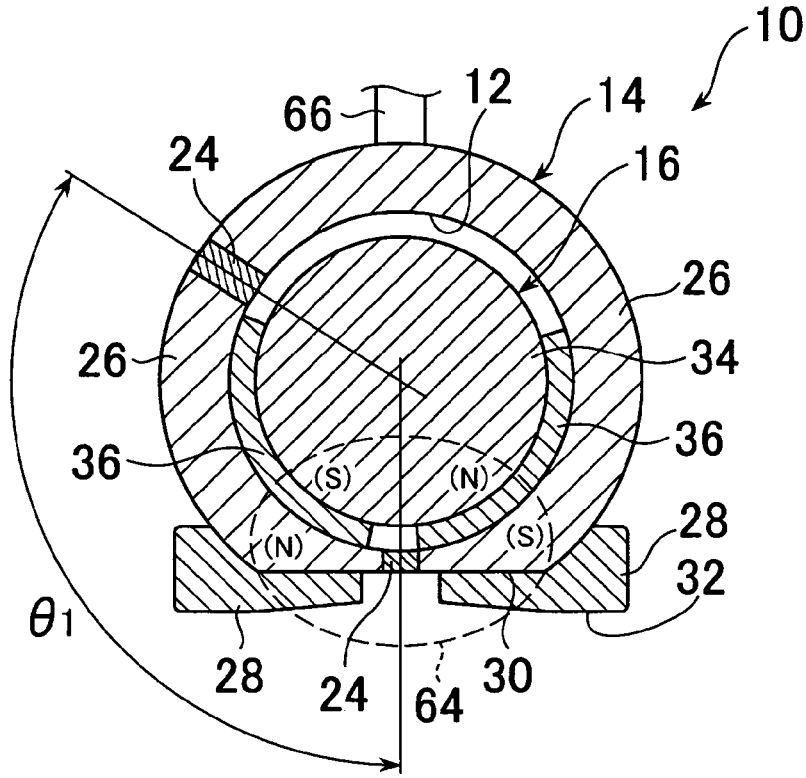
FIGS. 5(A) and (B) are sectional views obtained along the line 5—5 in FIG. 2, in which (A) shows the ON state and (B) the OFF state.

In the magnetic adsorption device 10, if the handle 22 is received in the first recess 40, the permanent magnet assembly 16 is in the first position shown in FIG. 5(A). In this state, one of the permanent magnets 36 of each set makes its S pole oppose to one of the magnetic pole members 26, and the other of the permanent magnets 36 makes the N pole oppose to the other magnetic pole member 26.

When the permanent magnet assembly 16 is in the first position, the magnetic flux from the permanent magnet 36, as shown by a dotted line 64 in FIG. 5(A), passes through one magnetic pole member 26, one seat 28, the other seat 28, the other magnetic pole member 26, the other permanent magnet 36 and the magnetic member 34. Consequently, the magnetic flux from the permanent magnets 36 leaks in the adsorption portion 32, so that the magnetic adsorption device 10 is turned on to be able to adsorb the magnetic substance.

Figure 5B:
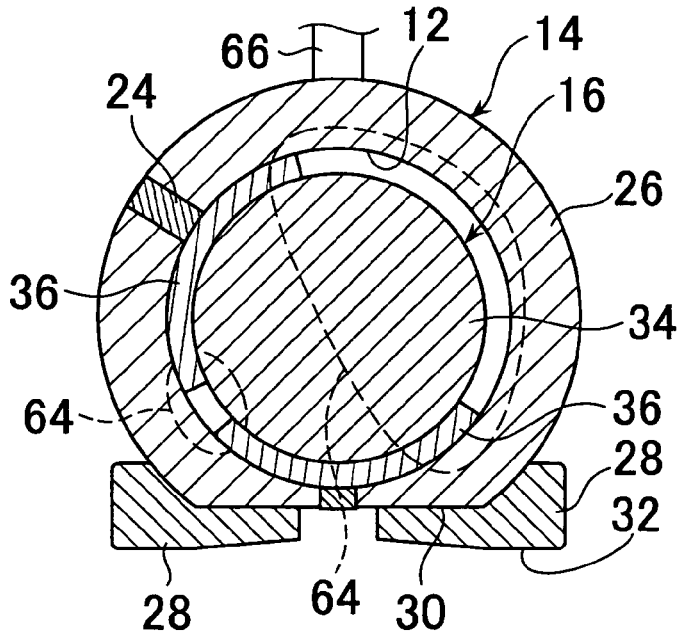
Figure 6:
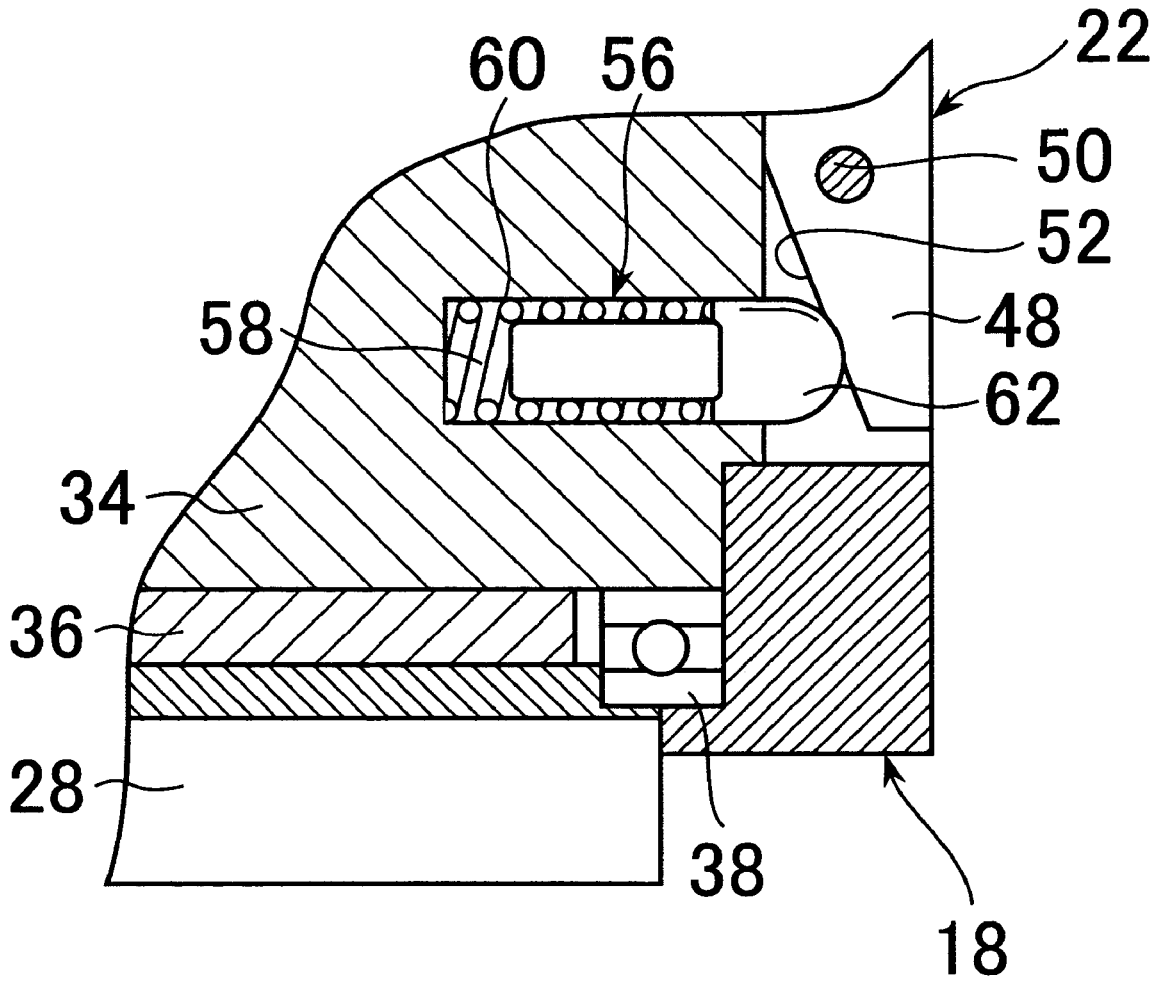
FIG. 6 is an enlarged sectional view of a portion inside the chain double-dashed line 6 in FIG. 4.
Figure 7:
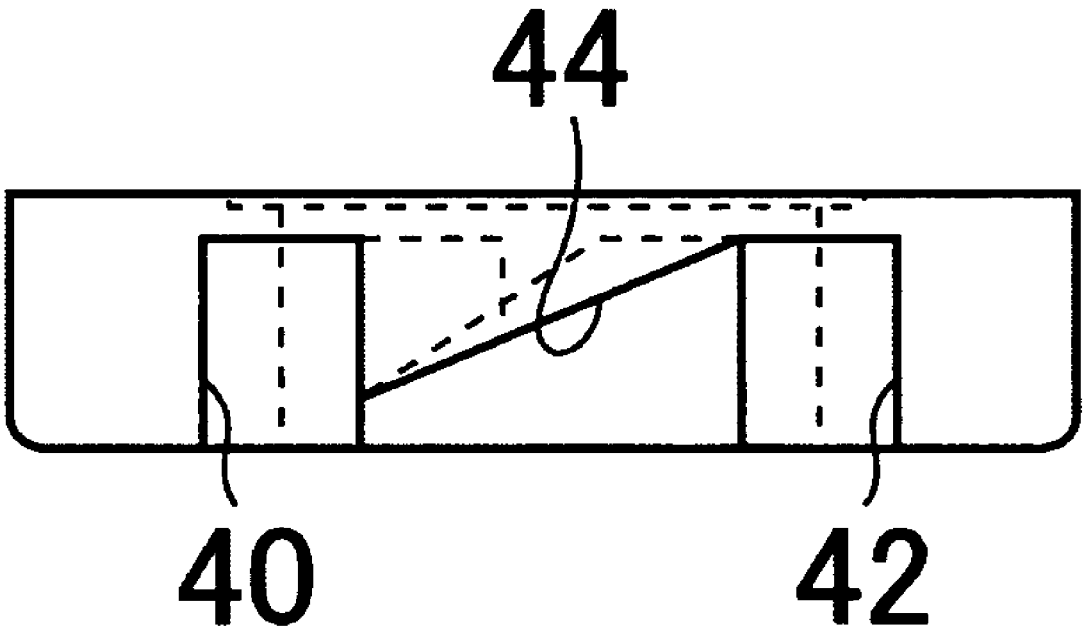
FIG. 7 is a plan view showing an embodiment of an end plate used in the magnetic adsorption device shown in FIG. 1.
Figure 8:
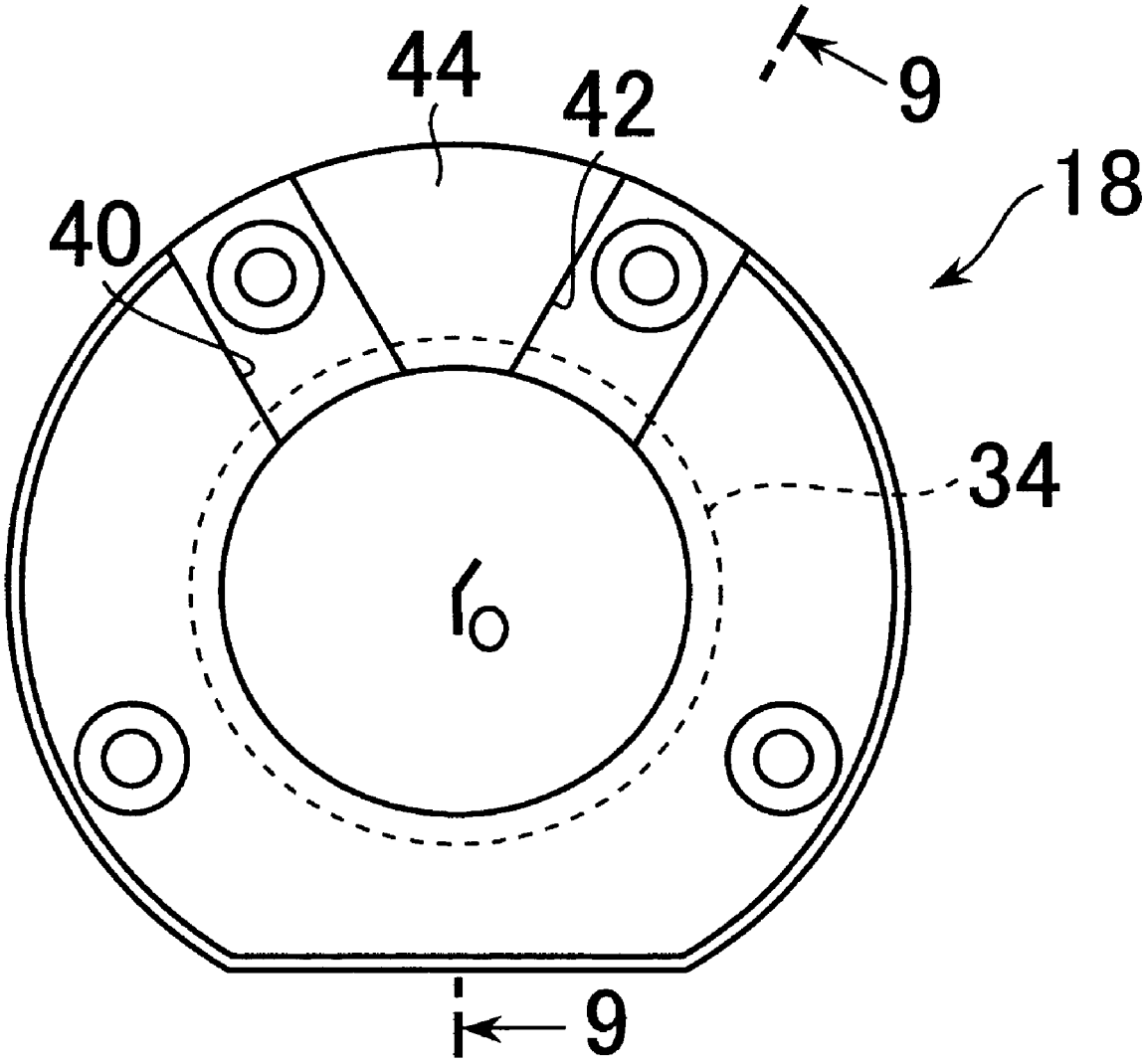
FIG. 8 is a front elevation of the end plate shown in FIG. 7.
Figure 9:
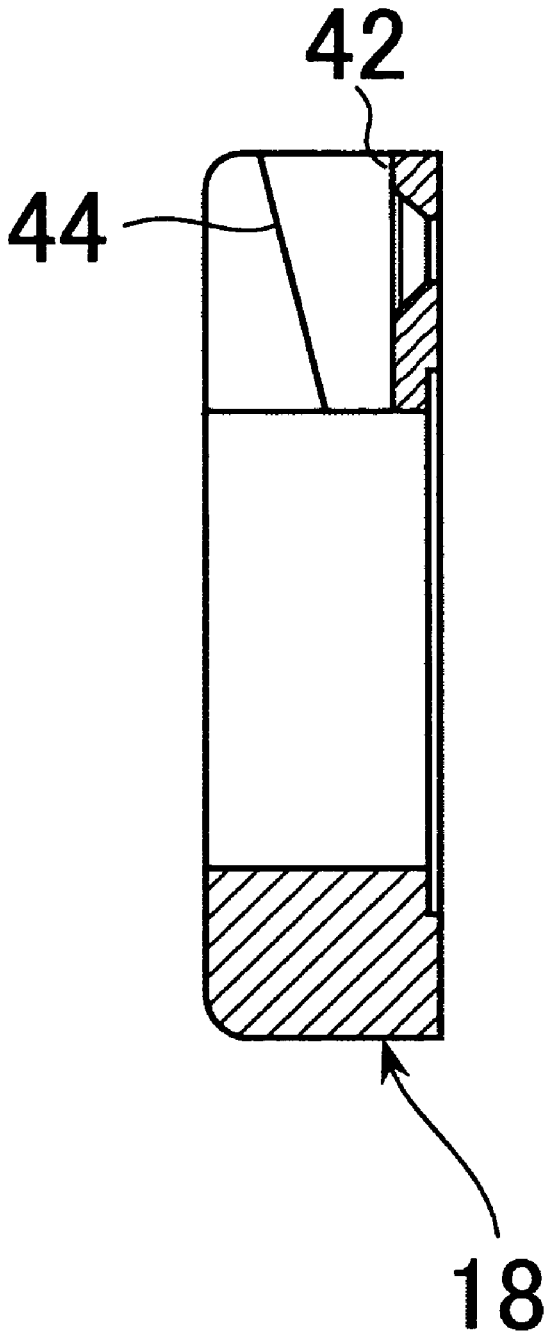
FIG. 9 is a sectional view obtained along the line 9—9 in FIG. 8.

On the other hand, if the handle 22 is received in the second recess 42, the permanent magnet assembly 16 is angularly rotated from the first position by an angle smaller than 90° to be rotated and moved to the second position shown in FIG. 5(B). In this state, all the permanent magnets 36 oppose to both magnetic pole members 26 through the spacers 24.

When the permanent magnet assembly 16 is in the second position, the magnetic fluxes from the permanent magnets 36 of each set, as shown by dotted lines 64 in FIG. 5(B), pass through closed loops short-circuited by the magnetic pole members 26 and the magnetic member 34. Consequently, none of the magnetic fluxes from the permanent magnets 36 leak in the adsorption portion 32, and the magnetic adsorption device 10 is turned off not to be able to adsorb the magnetic substance.

When the permanent magnet assembly 16 is maintained at the first position, the handle 22 is applied force by the pusher 56 and received in the first recess 40. Consequently, the magnetic adsorption device 10 is prevented from being switched from ON state to OFF state by mistake.

When rotating and moving the permanent magnet assembly 16 from the first position to the second position, it suffices to remove the handle 22 from the first recess 40 against the force of the pusher 56 and thereafter move the handle 22 toward the second recess 42.

On the other hand, when rotating and moving the permanent magnet assembly 16 from the second position to the first position, it suffices to remove the handle 22 from the second recess 42 against the force of the pusher 56, and thereafter to move the handle 22 toward the first recess 40.

When rotating and moving the permanent magnet assembly 16 from the first position to the second position or vice versa, it is possible to move the handle 22 in a state of being in contact with the inclined face 44 by the force of the pusher 56. This facilitates the switching work from ON to OFF or vice versa.

The amount of rotational movement of the permanent magnet assembly 16 necessary for turning the magnetic adsorption device 10 on or off becomes half the angle θ 1 formed between the pair of spacers 24. In the magnetic adsorption device 10, since the angle θ 1 is less than 180°, the amount of rotational movement of the permanent magnet assembly 16 becomes less than 90°. Therefore, while the initial adsorption force which the permanent magnets 36 has can be displayed, it is also possible to turn the adsorption device 10 on or off by a rotational operation at a small angle.

The angle θ 1 is preferably in an angular range from 50° to 150° and more preferably in an angular range from 60° to 120°. This enables to make the angle of rotational operation smaller without reducing the total adsorption force generated by the permanent magnet 36.

In the magnet adsorption device 10, since the plate-like permanent magnet 36 of high coersive force is used, a rotational resistance becomes small when selectively switching the magnetic adsorption device 10 from OFF to ON or vice versa, which facilitates the switching work.

By using a permanent magnet of low coersive force such as an alnico magnet, when the magnet adsorption device 10 is switched from OFF to ON, especially when the permanent magnet 36 separates from one of the magnetic pole members 34 from a state that the permanent magnet 36 opposes to both magnetic pole members 34, concentration of magnetic flux from the permanent magnet 36 occurs as the opposing area of the permanent magnet 36 to one of the magnetic pole members 34 becomes smaller. As a result, the rotational resistance acting on the handle 22 through the permanent magnet assembly 16 becomes great.

On the other hand, since the permanent magnet 36 can be made of a magnetic material with a large reversible permeability such as a ferrite magnet or a rare earth metal magnet, a concentration phenomenon of magnetic flux as mentioned above does not occur if such permanent magnet 36 is used. As a result, the rotational resistance at the time of switching from OFF to ON becomes small, thereby facilitating the switching work. However, a magnet of low coersive force may be used as the permanent magnet 36.

Also, in the magnetic adsorption device 10, since the cavity 12 and the magnetic member 34 have a circular cross sectional shape, and since the permanent magnet 36 is curved like an arc, it is possible to reduce the distance between the inner face of the cavity 12 and the permanent magnet 36. As a result, the adsorption force of the permanent magnet 36 can be more effectively shown.

However, while the sectional shapes of the cavity 12, the magnetic pole member 26, the magnetic member 34 and the like are circular, they may be polygonal such as hexagonal, octagonal, etc. Also, the permanent magnet 36 may or may not be bent like an L-shape according to the cross sectional shape of the magnetic member 34.

In the magnetic adsorption device 10, further, since much force acting on the permanent magnet assembly 16 can be absorbed by the magnetic member 34, the mechanical strength of the permanent magnet assembly 16 becomes higher than when the permanent magnet assembly is made of only a permanent magnet material.

The permanent magnet may be disposed such that the magnetic adsorption device 10 turns on when the handle 22 is received in the second recess 42, and turns off when the handle 22 is received in the first recess 40.

Consequently, in the present invention, either one of the first and the second positions acts as a rotation angle position where a line of magnetic force leaks in the adsorption portion to be capable of adsorbing a magnetic substance, while the other acts as a rotation angle position where a line of magnetic force does not leak in the adsorption portion and adsorption of the magnetic substance is not possible.

The magnetic adsorption device 10 is applied to a device for suspending an iron plate or a steel material. For this reason, the magnetic adsorption device 10 attaches a plate-like engaging member 66 made of a steel material to the magnetic pole member 26 having a large circumferential length. The engaging member 66 has a hole 68 for engaging a suspension member like a hook.

It is not necessary for the magnetic adsorption device 10 to be provided with the seats 28. In this case, it suffices that the adsorption portion 32 has a configuration which enables to effectively adsorb a adsorbable material in accordance with the configuration of the adsorption portion of the adsorbable material, and also the adsorption portion 32 can be directly formed in both magnetic pole members 26.

Figure 11:
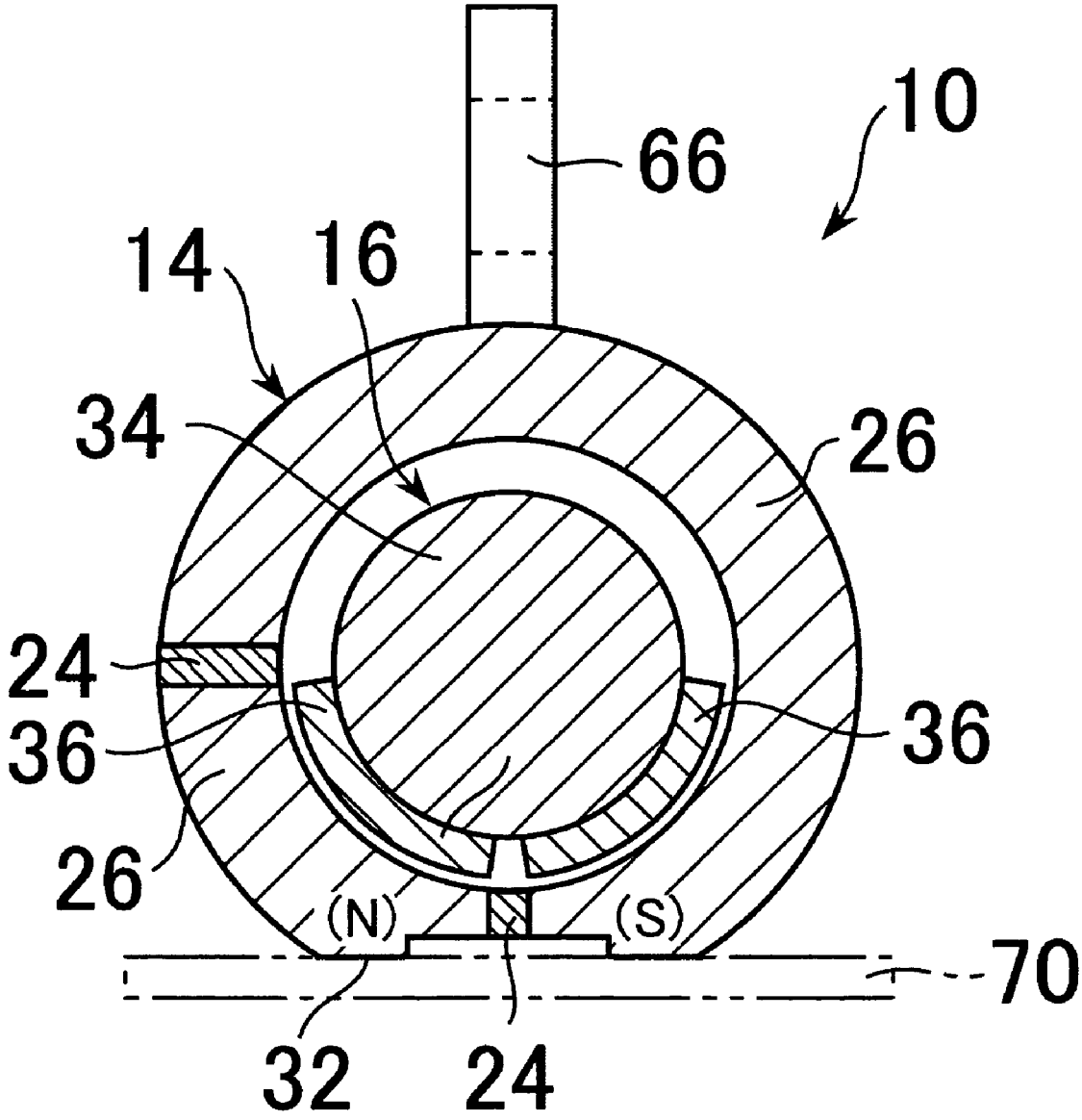
FIG. 11 is a view showing a first example of application of the magnetic adsorption device.

As shown in FIG. 11, when a adsorption portion of a adsorbent matter 70 is a flat portion such as a flat steel material, a region including the spacers 24 may be the flat adsorption portion 32 with a dented stage.

Figure 12:
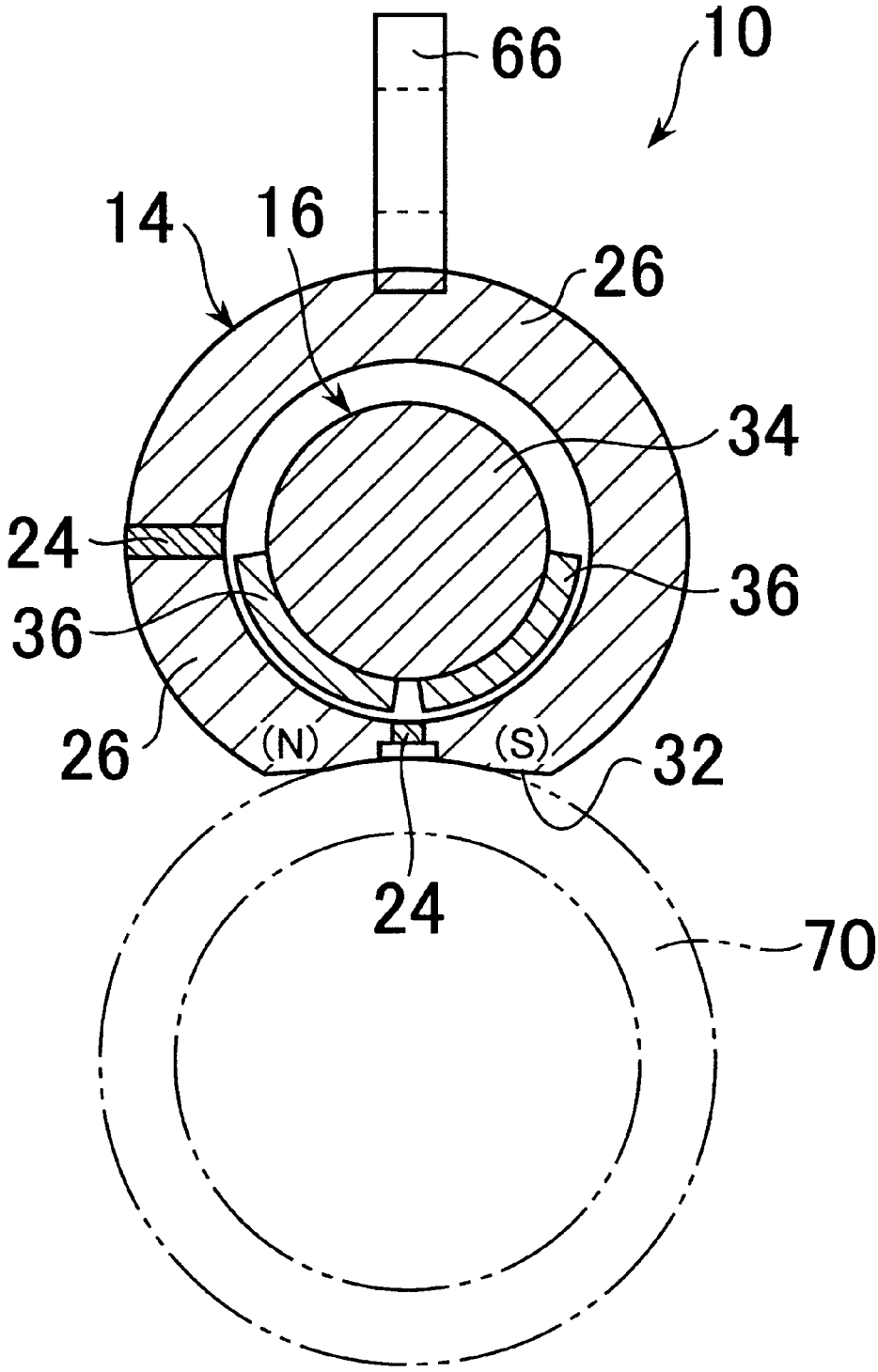
FIG. 12 is a view showing a second example of application of the magnetic adsorption device.

Also, as shown in FIG. 12, in case the adsorption portion of the adsorbent matter 70 is such an arc face portion as the outer peripheral face of a round steel material or a cylindrical material, the region including the spacers 24 can be a dented V-shaped adsorption portion 32.

Figure 13:
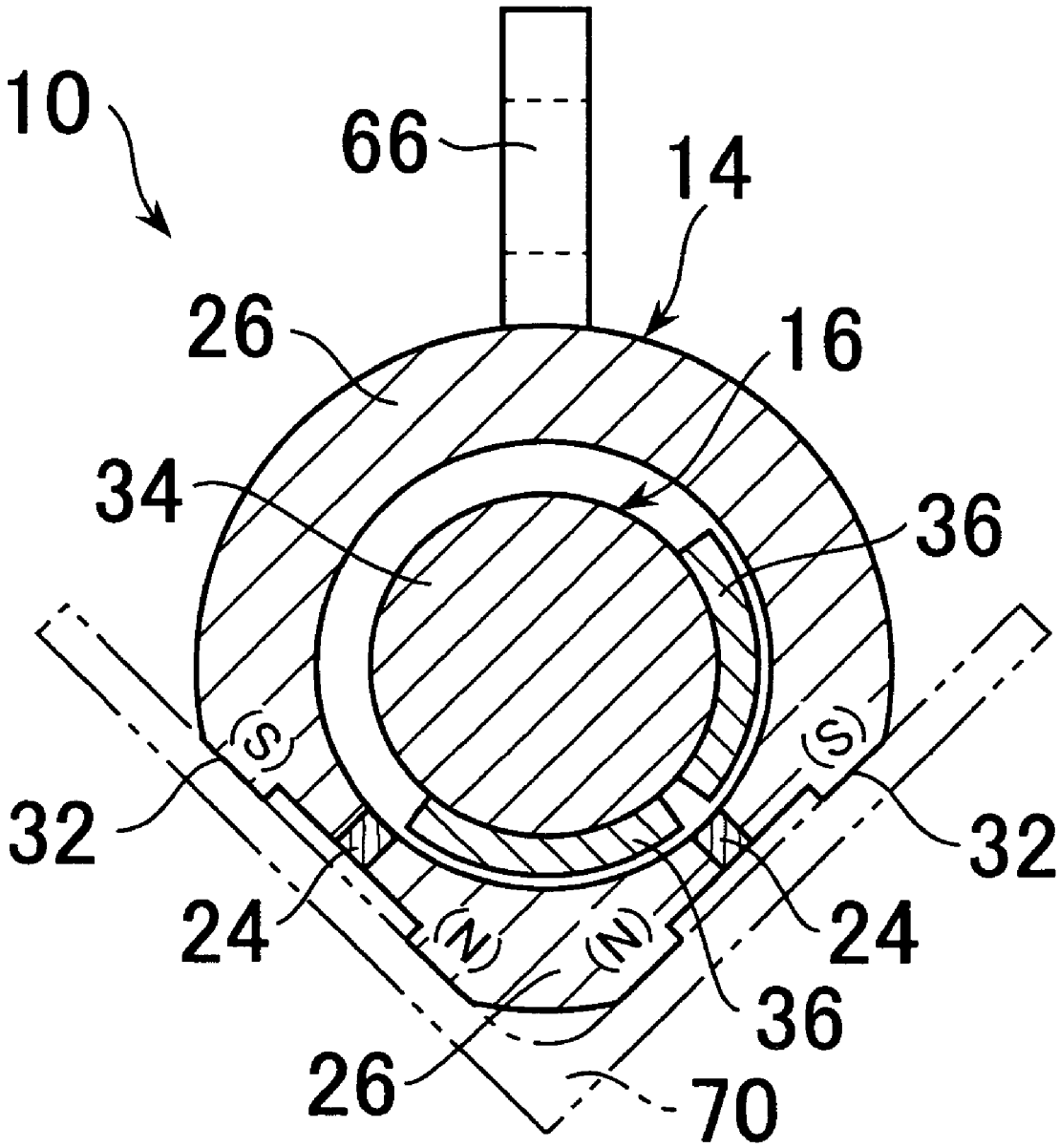
FIG. 13 is a view showing a third example of application of the magnetic adsorption device.

Further, as shown in FIG. 13, in case there exist two positions for the adsorption portions of the adsorbent matter 70 like both inner side faces of an L-shaped angle steel material, the adsorption portions 32 may be respectively formed in locations for them in both spacers 24.

The magnetic adsorption device 10 can be applied not only to a device for suspension but also for a fixing device such as a magnetic chuck and a magnet base. In any case, a known knob may be used in place of the handle 22. In case the magnetic adsorption device 10 is applied to the magnet base, a screw hole is formed in the magnetic pole member 26 in place of the engaging member 66.

Figure 14:
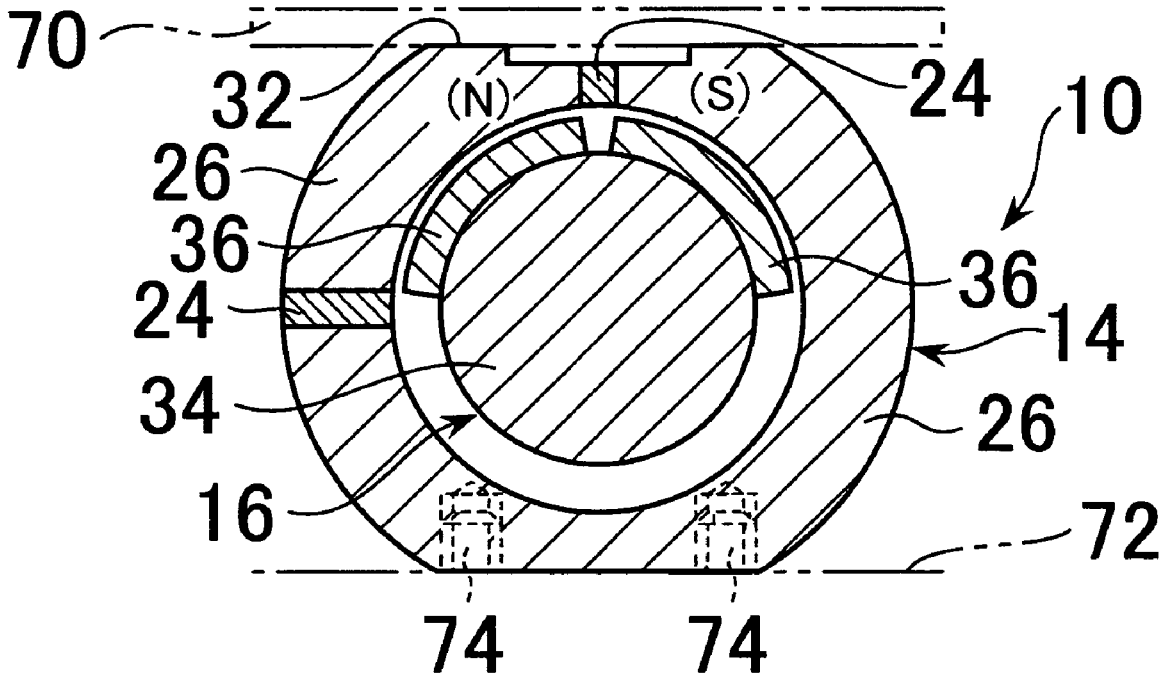
FIG. 14 is a view showing a fourth example of application of the magnetic adsorption device.
Figure 15:
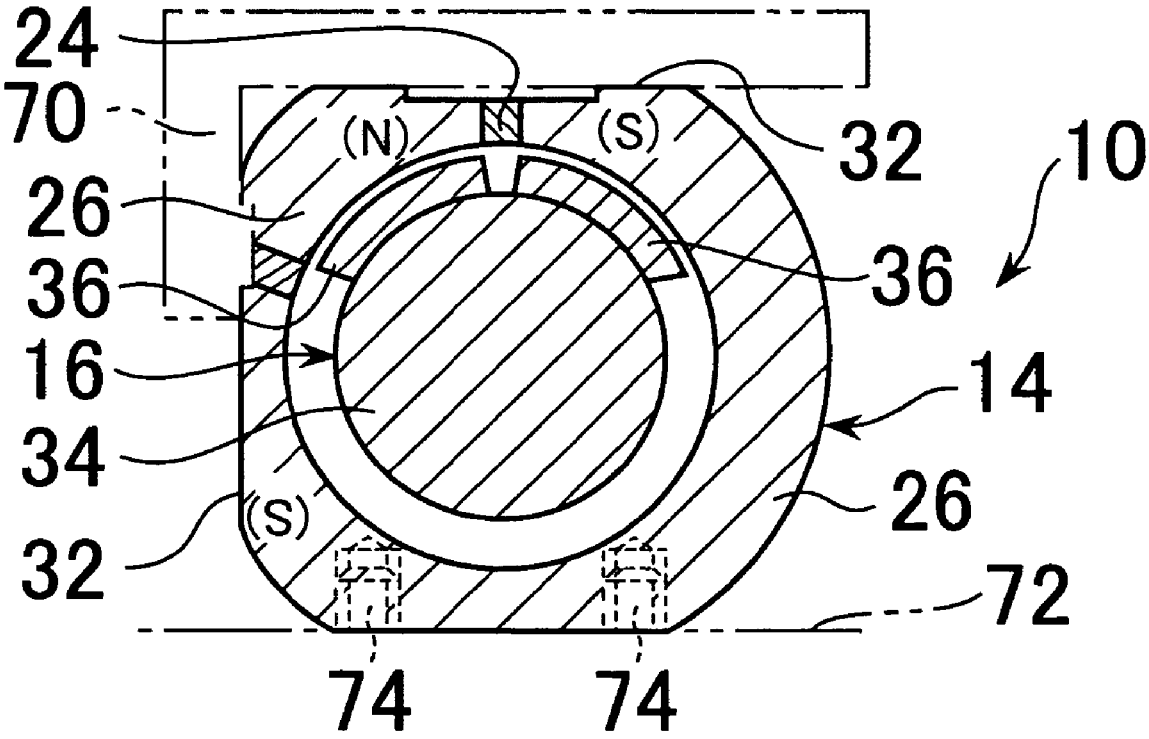
FIG. 15 is a view showing a fifth example of application of the magnetic adsorption device.

As shown in FIGS. 14 and 15, the magnetic adsorption device 10, when applied to a fixing device, can be attached to one of machine parts 72 such as a bed in one of the magnetic pole members 26 with a plurality of screw members 74. In either case of FIGS. 14 and 15, the magnetic adsorption device 10 is attached such that the adsorption portion 32 is directed upward, obliquely upward, sideward or the like, depending on the adsorbent matter 70 and the purpose of use.

In place of attaching the engaging member 66 to one of the magnetic pole members 26, an engaging member made of a non-magnetic material may be attached to both magnetic pole members 26 in a spanned state.

A non-magnetic material is, however, lower in mechanical strength than a magnetic material. It is, therefore, difficult to attach to the spacer located on the side opposite to the adsorption portion mounting members such as screw members for attaching the magnetic adsorption device to another machinery like a base of a machine tool, and engaging members for attaching mounting members to the magnetic adsorption device. Consequently, heretofore, such parts as an arm for attachment and a seat are additionally used for such screw members or engaging members.

On the other hand, the magnetic adsorption device 10, being capable of attaching such screw members or engaging members directly to the magnetic pole members 26, does not need such parts as an arm or a seat for attachment.

Embodiments of the Magnetic Apparatus

Figure 16:
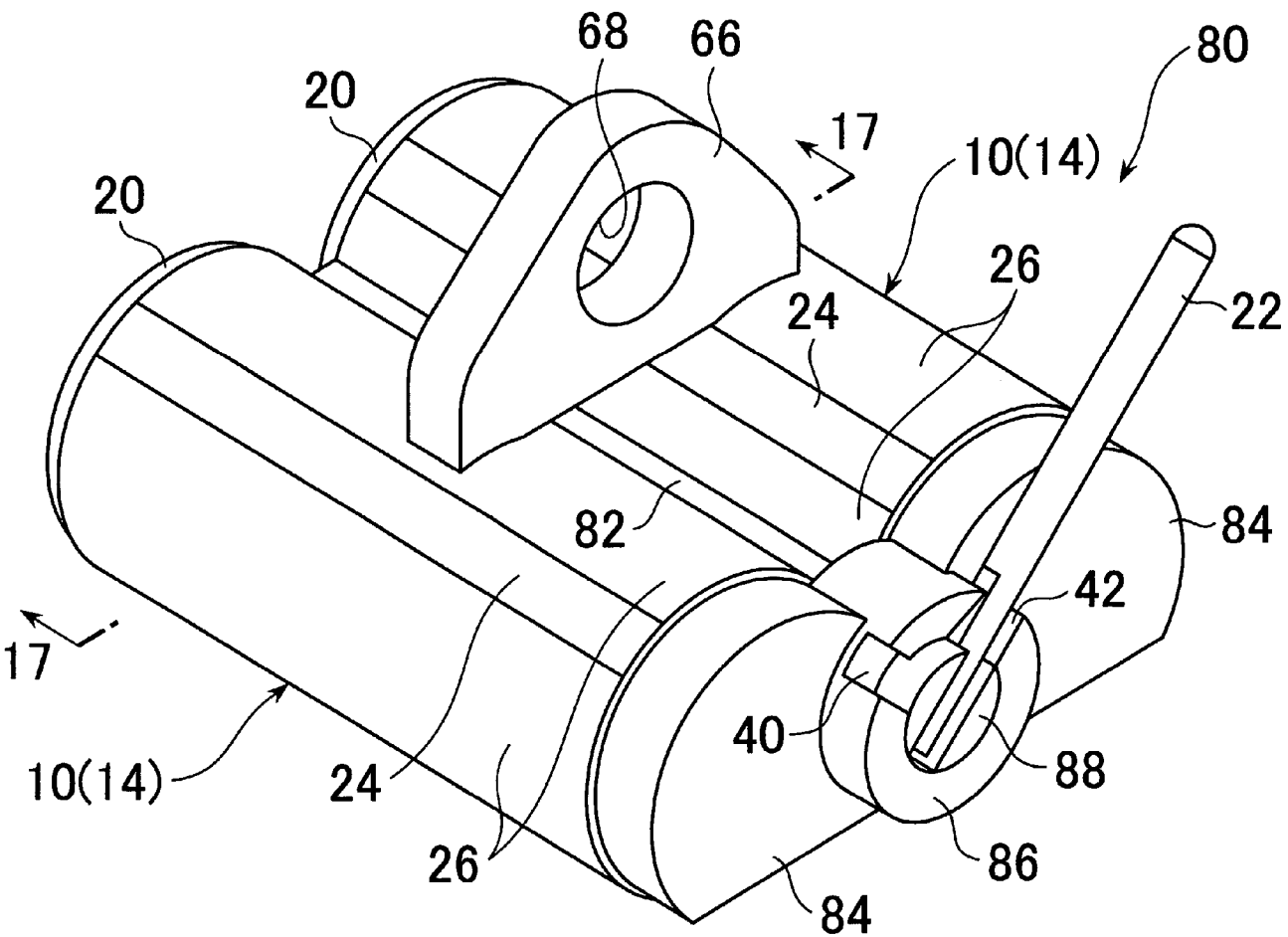
FIG. 16 is a perspective view showing an embodiment of the magnetic apparatus according to the present invention.
Figure 17:
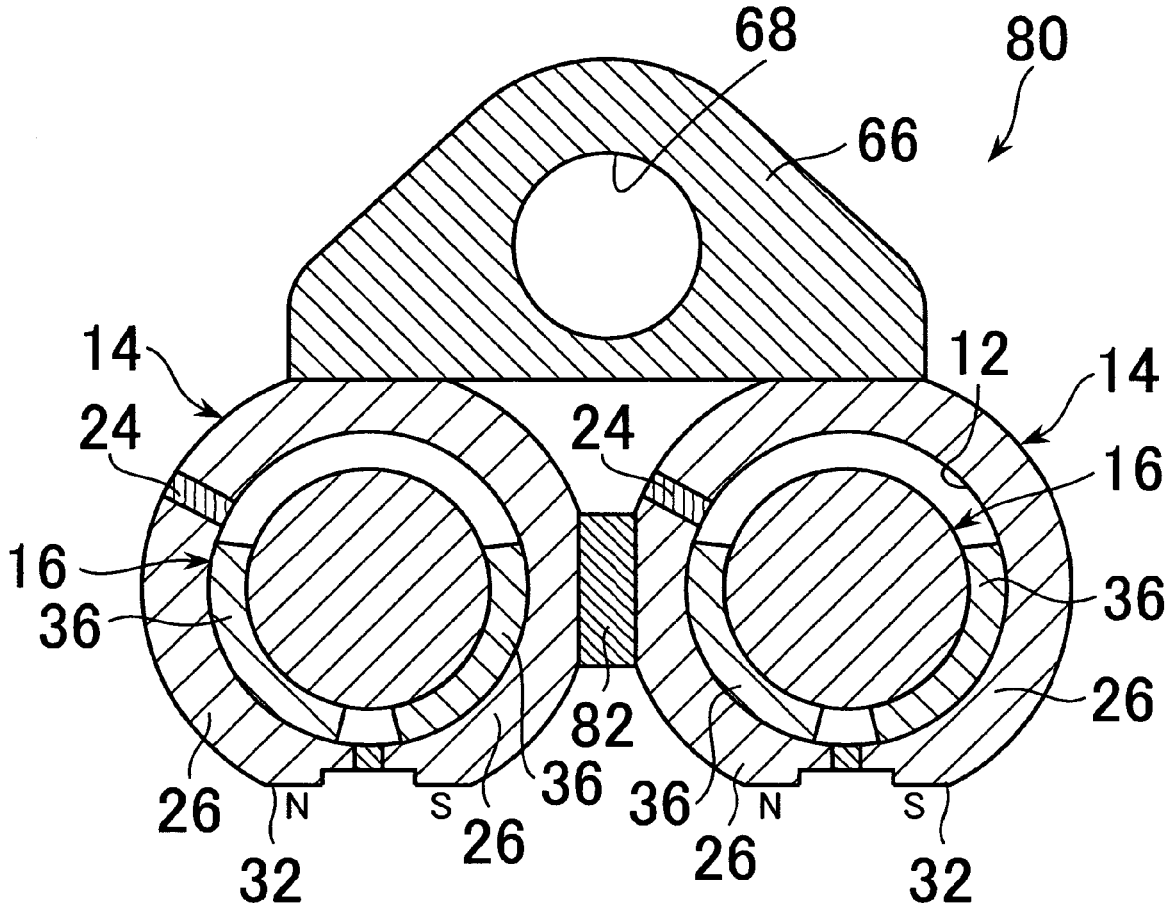
FIG. 17 is a sectional view obtained along the line 17—17 in FIG. 16.

Referring to FIGS. 16 and 17, a magnetic apparatus 80 includes two magnetic adsorption devices 10 having such a constitution as mentioned above and a connecting member 82 connected with both magnetic adsorption devices. Both magnetic adsorption devices 10 do not have any seat 28 but has a cap 84 instead of the end plate 18, and moreover, share the handle 22 and the engaging member 66.

Consequently, the magnetic adsorption device 80 attaches a circular plate 86 formed like a ring-shaped cap corresponding to the end plate 18 to the cap 84, disposes a main gear 88 (of which only the shaft is shown in FIG. 16) inside the circular plate 86. The main gear 88 is rotatably supported on the circular plate 86. The caps 84, 84 and the circular plate 86 may be integral.

The handle 22 is connected to the rotational axis of the main gear supported on the circular plate 86. The rotation of the main gear by the handle 22 is transmitted to a driven gear disposed inside each cap 82 to be transmitted from the driven gear to a corresponding permanent magnet assembly 16. The driven gear can be attached to one end portion of the already mentioned magnetic member 34.

The connecting member 82 and the engaging member 66 are formed by a non-magnetic material and welded or adhered to the magnetic pole members 26 of both magnetic adsorption devices 10. However, as in the illustration, in case the engaging member 66 is disposed so as to bridge the magnetic pole members 26 of both magnetic adsorption device 10, the connecting member 82 and the engaging member 66 may be made of a magnetic material.

The magnetic apparatus 80 can raise the adsorption force without enlarging the device 80 itself, in comparison with a case where one magnetic adsorption device 10 is used.

Figure 18:
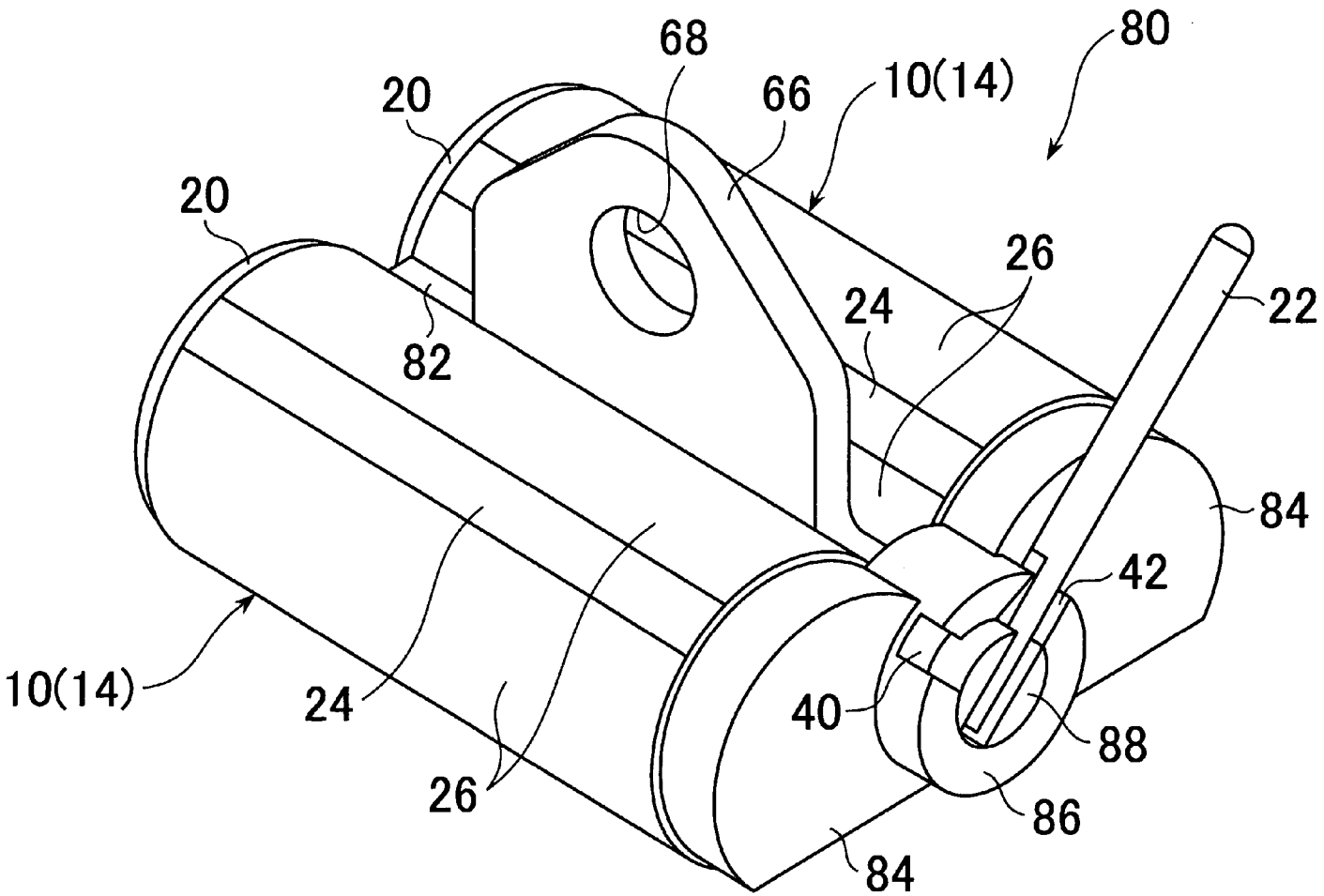
FIG. 18 is a perspective view showing another embodiment of the magnetic apparatus according to the present invention.

The engaging member 66 may be attached to the connecting member 82 so as to extend in parallel to both magnetic adsorption devices 10 as shown in FIG. 18, in place of having the engaging member 66 connected with the magnetic adsorption devices 10 so as to bridge the magnetic pole members 26 of both magnetic adsorption devices 10. It is also possible to have three or more magnetic adsorption devices 10 connected in parallel by a plurality of connecting members.

Figure 19:
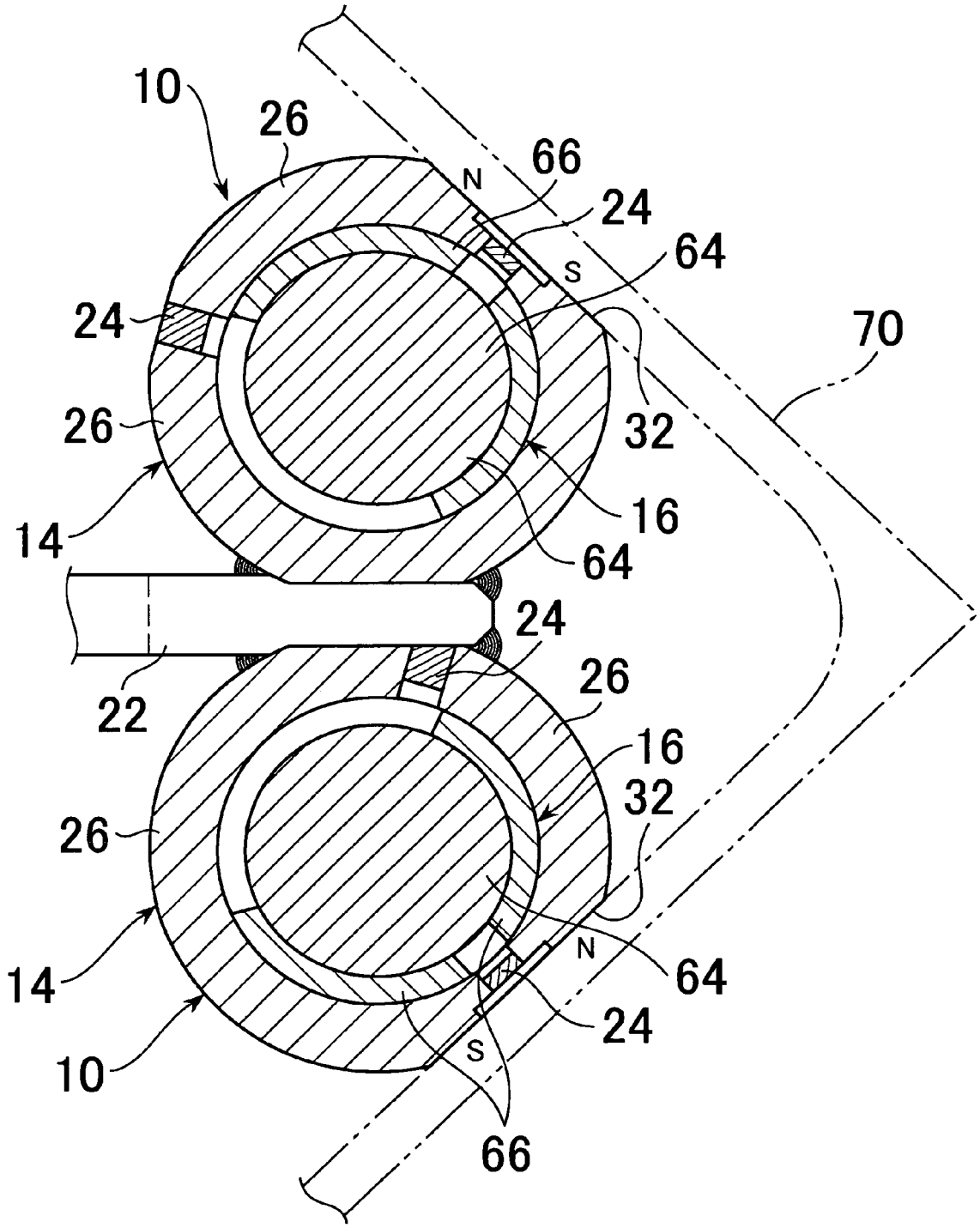
FIG. 19 is a perspective view showing still another embodiment of the magnetic apparatus according to the present invention.

It is possible to connect one or more engaging members 66 with a plurality of magnetic adsorption device 10 as shown in FIG. 19 and to omit the connecting member 82.

Embodiments of Production Method

With reference to FIG. 20, embodiments of production method of the magnetic adsorption device 10, especially, of the magnetic circuit block 14 are explained in the following.

Firstly, a cylindrical member 90 made of a magnetic material is prepared, and the cylindrical member 90 is cut off by a cutting machine into a length a little longer than the length of the magnetic circuit block 14.

Figure 20A:
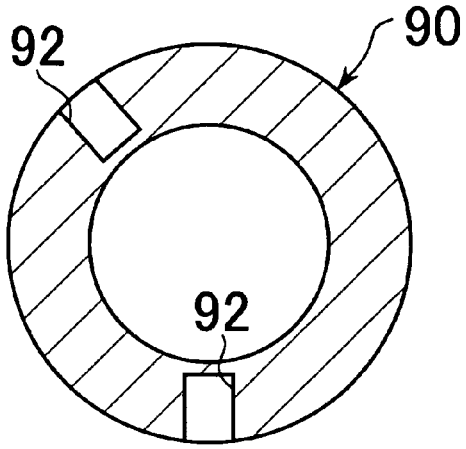
FIG. 20 is a view for explaining the production method according to the present invention.

Next, as shown in FIG. 20(A), grooves 92 opening in the outer peripheral face of the cylindrical member 90 and extending in the longitudinal direction of the cylindrical member 90 are formed at intervals in the circumferential direction of the cylindrical member 90 at a plurality of portions (two in the illustration) by cutting work, milling and the like. Each groove 92 has such a depth as leaving a part of the inner periphery of the cylindrical member 90 and a length covering a range of the full length of the cylindrical member 90.

Figure 20C:
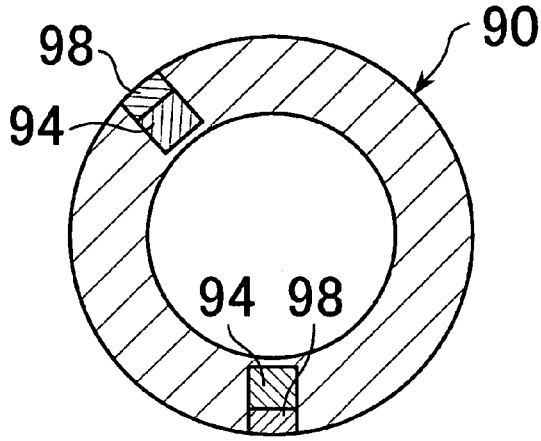
Figure 20B:
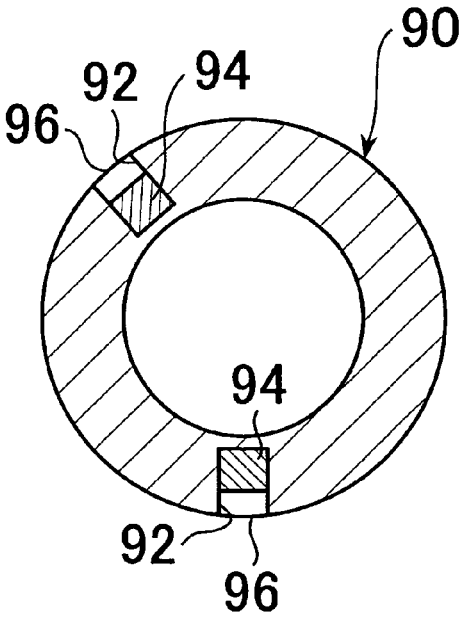

Next, as shown in FIG. 20(B), a strip-shaped non-magnetic member 94 is disposed in each groove 92 with one edge portion of the non-magnetic member 94 in its width direction brought into contact with the bottom of the groove 92. The thickness and the length of each non-magnetic member 94 are approximately the same as the width and the length of the groove 92, respectively, but the width of the non-magnetic member 94 is smaller than the depth of the groove 92. Therefore, in a state that the non-magnetic member 94 is disposed in the groove 92, a groove space 96 is formed in a portion on the side of the opening of the groove. 92.

Then, as shown in FIG. 20(C), each non-magnetic member 94 is bonded to the cylindrical member 90 by welding using a non-magnetic material. This welding is done in a form of padding to fill a non-magnetic welding material 98 in the groove space 96. In place of welding, it is possible to use a rigid adhesive containing a non-magnetic material to bond the non-magnetic member 94 to the cylindrical member 90.

Figure 20D:
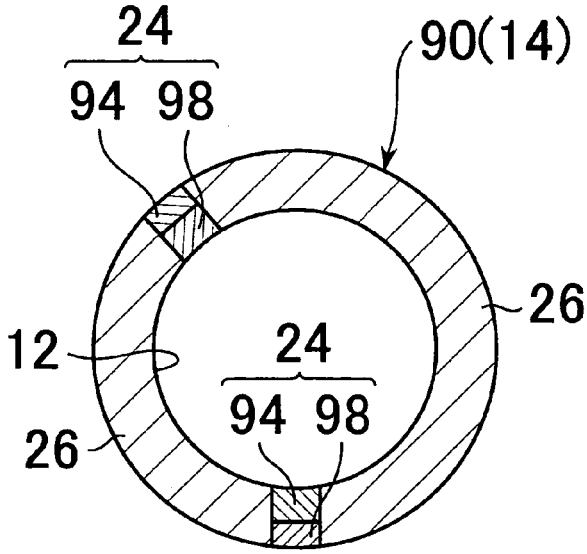

Then, as shown in FIG. 20(D), the inner peripheral face of the cylindrical member 90 is removed by machining such as cutting, milling or the like. The inner peripheral face of the cylindrical member 90 may be removed until the non-magnetic member 94 is exposed, or to such a degree as the leakage of the magnetic flux between the regions of the cylindrical member divided by the groove 92 can be ignored.

In such a product as mentioned above, each remaining region of the cylindrical member 90 is used as the magnetic pole members 26 of the magnetic circuit block 14, and the non-magnetic member 94 and the padding welding material 98 act as the spacer 24.

According to the above-mentioned production method, in comparison with machining the inner face of the cavity after connecting a plurality of magnetic pole members by spacers, connecting work of the magnetic pole members and machining work of the inner face of the cavity become easier since it is possible to weld the non-magnetic members 94 and the magnetic pole members with each non-magnetic pole member 94 disposed in the groove 92 and to machine the inner face of the cavity.

As shown in FIG. 19, if the adsorbent matter 70 is a deformed material such as an L-shaped steel, the adjoining magnetic adsorption devices 10, 10 may be connected with an angular space around an imaginary circle. By this, the L-shaped deformed material can be surely adsorbed.

As a result, either one of the first and second positions acts as a rotational angle position where the line of magnetic force leaks in the adsorption portion and which is capable of adsorbing a magnetic substance to the adsorption portion, while the other acts as a rotational angle position where the line of magnetic force does not leak in the absorption portion and which is not capable of adsorbing a magnetic substance to an absorbing portion.

The present invention is not limited to the foregoing embodiments but can be variously modified without departing from its spirit.

What is claimed is:

1. A magnetic adsorption device comprising:

a magnetic circuit block having a cavity extending in one direction and divided into a plurality of magnetic pole members at intervals in the circumferential direction of said cavity by a plurality of radially aligned spacers; and a permanent magnet assembly having an N pole and an S pole and capable of selectively rotating at a first and a second positions spaced apart about an axis of said cavity so as to adsorb and release a magnetic substance;

wherein said spacers adjoining about said axis are at angular intervals smaller than 180° about said axis.

2. A magnetic adsorption device according to claim 1, wherein said spacers adjoining about said axis are at angular intervals from 50° to 150°.

3. A magnetic adsorption device according to claim 1, wherein said spacers adjoining about said axis are at angular intervals from 60° to 120°.

4. A magnetic adsorption device according to claim 1, wherein said permanent magnet assembly includes a bar-like magnetic member disposed in said cavity and a pair of permanent magnets disposed around said magnetic member, wherein one and the other of the permanent magnets directs one and the other of the N pole and the S pole toward said magnetic member and directs the other and the one of the N pole and the S pole toward the inner face of the cavity.

5. A magnetic adsorption device according to claim 4, wherein said permanent magnet includes a plate-like magnet with high coersive force magnetized in its thickness direction.

6. A magnetic adsorption device according to claim 5, wherein said cavity and said magnetic member have a circular sectional shape and said permanent magnet is curved like an arc.

7. A magnetic adsorption device according to claim 1, further comprising:

an end plate attached to one end portion of said magnetic circuit block in said axial direction and having a through hole for receiving a part of said permanent magnet assembly in said axial direction; and a rotating member connected with one end portion of said permanent magnet assembly in the direction said axis so as to angularly rotate said permanent magnet assembly about said axis.

8. A magnetic adsorption device according to claim 7, wherein said rotating member includes a handle connected with one end portion of said permanent magnet assembly so as to angularly rotate about an imaginary axis extending in a direction crossing the axis of said cavity, and wherein said end plate has a first and a second recesses for receiving said handle so as to selectively maintain said permanent magnet assembly at a first and a second position releasably.

9. A magnetic adsorption device according to claim 8, further comprising a pusher disposed in said permanent magnet assembly so as to apply force to said handle in a direction that said handle is received in said first and second recesses.

10. A magnetic adsorption device according to claim 9, wherein said end plate further has an inclined plane between said first and second recesses, said inclined plane going away from the side of said magnetic circuit block, the nearer either one side of said first and second recesses.

11. A magnetic adsorption device according to claim 1, wherein said magnetic circuit block may have at least one magnetic adsorption portions.

12. A magnetic apparatus comprising: a plurality of magnetic adsorption devices described to any one of claims 1 through 11; and a connecting member for connecting said plurality of magnetic adsorption devices.

13. A magnetic apparatus according to claim 12, wherein said connecting member includes a hole capable of engaging a suspension member.

14. A magnetic apparatus according to claim 12, further comprising an engaging member connected with said connecting member or said magnetic adsorption devices, wherein said engaging member has a hole capable of engaging a suspension member.

15. A magnetic apparatus according to claim 12, wherein each said magnetic adsorption device has at least one magnetic adsorption portion, and wherein adjoining magnetic adsorption devices are connected so that said magnetic adsorption portion may be located on the same side.

16. A magnetic apparatus according to claim 12, wherein each said magnetic adsorption device has at least one magnetic adsorption portion, and wherein adjoining magnetic adsorption devices are connected such that said magnetic adsorption portions are located at angular intervals around an imaginary circle.

* * * * *